United States Patent [19]

Lavery

[11] 4,388,993

[45] Jun. 21, 1983

[54] MULTIPLE ACCESS CARTON

[75] Inventor: John J. Lavery, Chicago, Ill.

[73] Assignee: Champion International Corporation, Stamford, Conn.

[21] Appl. No.: 228,114

[22] Filed: Jan. 26, 1981

[51] Int. Cl.[3] ..... B65D 5/10; B65D 5/54

[52] U.S. Cl. ..... 206/611; 206/625; 229/39 R; 229/DIG. 14; 229/41 C

[58] Field of Search ..... 229/41 C, 39 R, DIG. 14; 206/625, 626

[56] References Cited

U.S. PATENT DOCUMENTS

| | | | |
|---|---|---|---|
| 2,314,631 | 3/1943 | Ray | 229/41 C |
| 2,903,180 | 9/1959 | Holmes | 206/625 |
| 3,167,238 | 1/1965 | Smith | 206/625 |
| 3,195,796 | 7/1965 | Buttery | 206/626 |
| 3,319,869 | 5/1967 | Ostwald | 229/39 |
| 3,467,298 | 9/1969 | Wysocki | 229/41 C |
| 4,260,100 | 4/1981 | Hoffman | 229/39 |
| 4,287,998 | 9/1981 | Zimmerman | 229/DIG. 14 |

*Primary Examiner*—Steven P. Garbe

*Attorney, Agent, or Firm*—Evelyn M. Sommer; John H. Mulholland

[57] ABSTRACT

A multiple access carton particularly adapted for food products, comprising top, bottom and side wall members integrally connected by fold lines to form a carton body, major and minor panels on each end of the carton for detachably interlocking with each other to form an end closure and a tear strip formed in and extending across the top wall and being of sufficient width whereby the content of the carton may be retrieved through either of the end closures or the top wall when the tear strip is removed.

7 Claims, 4 Drawing Figures

MULTIPLE ACCESS CARTON

BACKGROUND OF THE INVENTION

The present invention relates to cartons and in particular to a quick set up and multiple access carton which enables products to be completely contained within the carton, allows the cartons to be stacked on their end panels, side panels, or top or bottom panels and allows the products to be retrieved either through the end closures or through the top wall of the carton simply by removing a portion of the top wall which is formed into a tear strip. The carton is particularly adapted for foods, such as french fries, and will be described in connection therewith.

Present requirements for quick set up cartons for the fast food market include a carton that can be shipped in its flat state or condition, quickly be set up into its fully tubed and folded state, and has a bottom closure panel which can be readily assembled and interlocked and an open top into which the product such as french fries can be loaded and dispensed. These cartons, particularly when used with a product such as french fries, have a tendency to fall over or be moved sharply whereby at least part of the contents fall out. Thus, part of the contents may fall on the floor or in other areas that are not sanitized and, further, create cleanliness problems by being inadvertently scattered as the holder of the carton moves from one location to another.

SUMMARY OF THE INVENTION

The present invention overcomes the problems and disadvantages of the prior art quick set up cartons for the fast food market by providing a quick set up carton that can be shipped in its flat state and then quickly assembled and set up for use in receiving the particular product intended to be placed therein. Also, the carton can be stacked in any one of three positions after it has been filled with the desired product. It can be stacked on either end, on either the top or the bottom or on either side.

Also not only is the product securely contained within the carton so as to prevent inadvertent discharge thereof, but also, it can be easily removed through opening either end of the carton or by laying the carton on its bottom wall and removing a tear strip which extends across the top wall and which is of sufficient width to allow the product to be exposed and removed. Finally, the panels which form the end wall closures are detachably connected to the carton and thus can be totally removed if desired in order to obtain the contents of the carton.

Thus, the invention relates to a quick set up and multiple access carton comprising top, bottom, and side wall members integrally connected by fold lines to form a carton body, major and minor panels on each end of said carton for nonadhesively and mechanically detachably interlocking with each other to form an end closure and a tear strip formed in and extending across said top wall and being of sufficient width whereby the contents of said carton may be retrieved through either of said end closures or said top wall when said tear strip is removed.

The present invention also relates to a novel carton blank comprising a top and bottom wall each formed of equal size first and second panels, first and second side walls formed of equal size third and fourth panels of smaller width than said first and second panels, said first side wall integrally formed with and attached to said top and bottom walls, said second side wall integrally formed with and attached to the remaining side edge of said bottom wall whereby an octagonal carton is formed when said blank is folded and tubed, a glue flap integrally formed with and hingedly attached to the remaining side edge of said top wall for overlapping the adjacent side wall when said carton blank is folded and tubed, a generally U-shaped major end panel integrally formed with and hingedly extending from each end of said top wall panel, a triangular shaped locking tab integrally formed with and located at the bottom of said U and a triangular shaped projection formed by said minor end panel for overlapping the arms of said U-shaped major end panel and extending under said triangular shaped locking tab when said carton is folded and tubed to detachably interlock said major and minor end panels thereby forming end closures.

BRIEF DESCRIPTION OF THE DRAWINGS

These and other objects and attendant advantages of the present invention will be disclosed in the course of the following specification, reference being had to the accompanying drawings, in which like numerals represent like elements and in which.

DETAILED DESCRIPTION OF THE DRAWINGS

Figure 1:
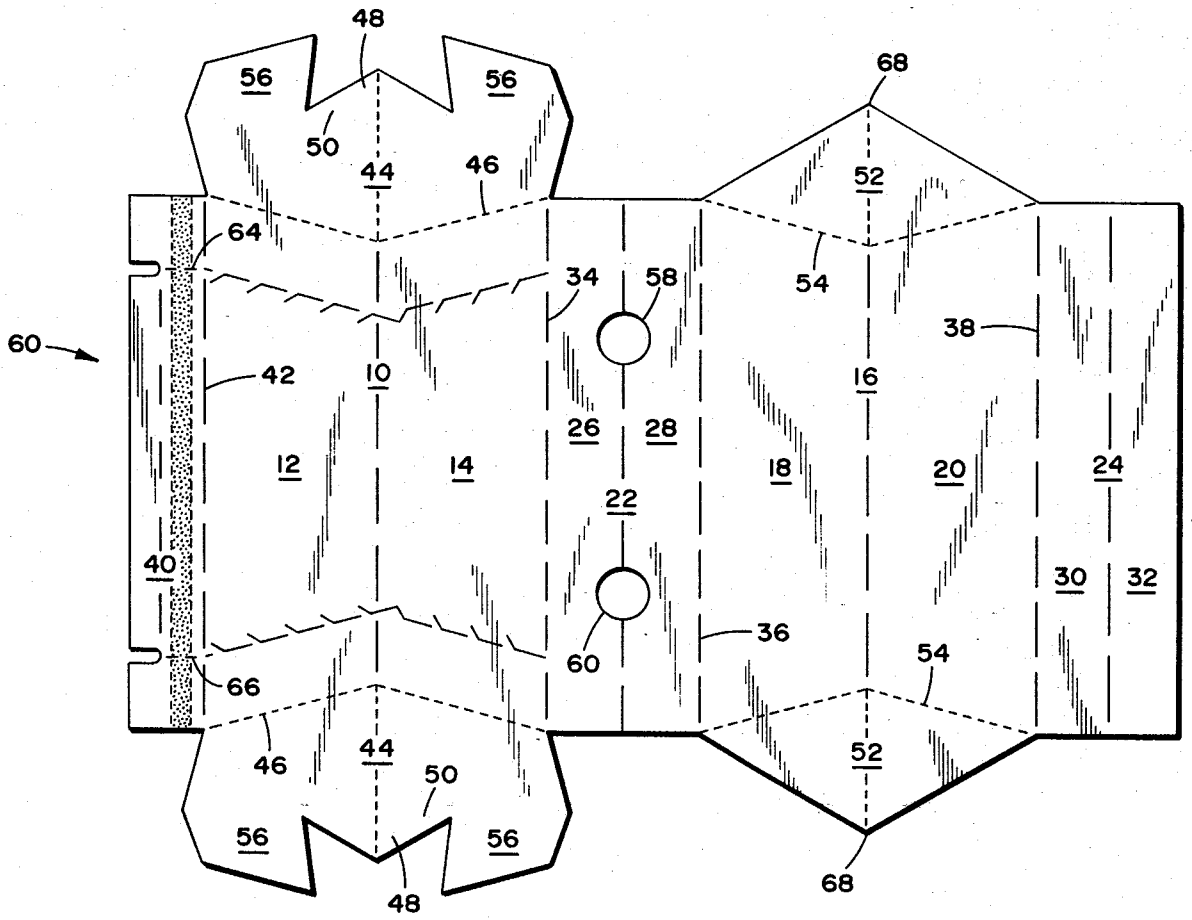
FIG. 1 is a plane view of the novel blank used to form the carton of the present invention.

The blank from which the novel carton of the present invention can be formed is illustrated in FIG. 1. It comprises a top or front wall 10 formed of equal size first and second panels 12 and 14 and a bottom or back wall 16 also formed of equal size first and second panels 18 and 20. The panels 12 and 14 are also the same size as the panels 18 and 20. First and second side walls 22 and 24 are formed of equal size third and fourth panels 26, 28 and 30, 32, respectively. These third and fourth panels 26, 28, and 30, 32 are of smaller widths than first and second panels 12, 14 and 18, 20. First side wall 22 is integrally formed with and hingedly attached to the top wall 10 along score line 34 and to bottom wall 16 along score line 36. Second side wall 24 is integrally formed with and hingedly attached to the remaining side edge 38 of said bottom wall 16 whereby an octagonal carton is formed when the blank is tubed and folded. A glue flap 40 is integrally formed with and hingedly attached to the remaining side edge 42 of top wall 10 for overlapping the adjacent side wall 24 when the carton blank is folded and tubed. A generally U-shaped major end panel 44 is integrally formed with and hingedly extending from each end of said front wall 10 along tear line 46. A triangular shaped locking tab 48 is integrally formed with and located at the bottom 50 of the U formed by the major end panel 44 and extends toward the open end of said U. A minor end panel 52 is formed in the shape of a triangular projection integrally formed with and detachably connected to each end of said bottom wall 16 along tear line 54 and is used to overlap the arms 56 of U-shaped major end panel 44 and extending under the triangular shaped locking tab 48 when the carton is folded and tubed to detachably interlock the major and minor end panels 44 and 52 thereby forming end closures. Orifices 58 and 60 in side wall 22 are utilized as heat vents whenever a heated product is placed inside the carton. A tear strip 62 is formed in glue flap 40 by tear lines 64 and 66 which extend across both first and second panels 12 and 14 of top wall 10 so that by grasping the center part of glue flap 40, tear strip 62 is removed from the carton by tearing along tear lines 64 and 66 to thus expose the contents of the carton. Tear strip 62 is of sufficient width to allow the contents of the carton to be easily removed.

Figure 2:
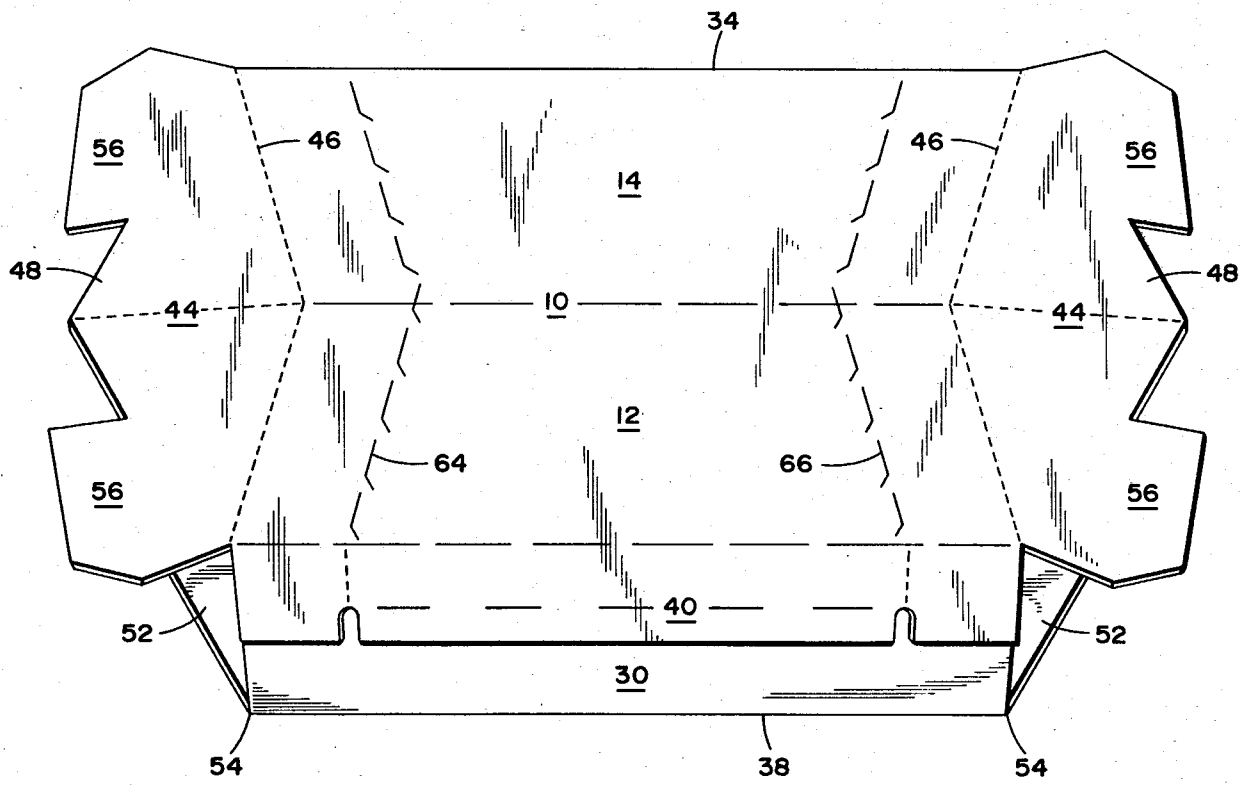
FIG. 2 is a view of the partially folded and tubed blank shown in FIG. 1 to form a carton with the major end panels visible in their unclosed state.

The tubed and partially folded carton constructed from the blank of FIG. 1 is illustrated in FIG. 2. To obtain the carton of FIG. 2 from the blank of FIG. 1, simply fold the top wall 10 and bottom wall 16 about their respective score lines 34 and 36 connecting them to side wall 22 until top wall 10 is parallel to and above bottom wall 16. Side wall 24 may then be folded upwardly about score line 38 and glue flap 40 is folded downwardly about score line 42 so that it overlaps upper panel 32 of side wall 24. It is then glued to panel 32 of side wall 24. The carton can then be shipped in a flattened state in this condition simply by pressing down on the top wall 10 and moving it in the direction of one side edge of bottom wall 16 by folding of the carton about hinge lines 34, 36, 38 and 42.

Figure 4:
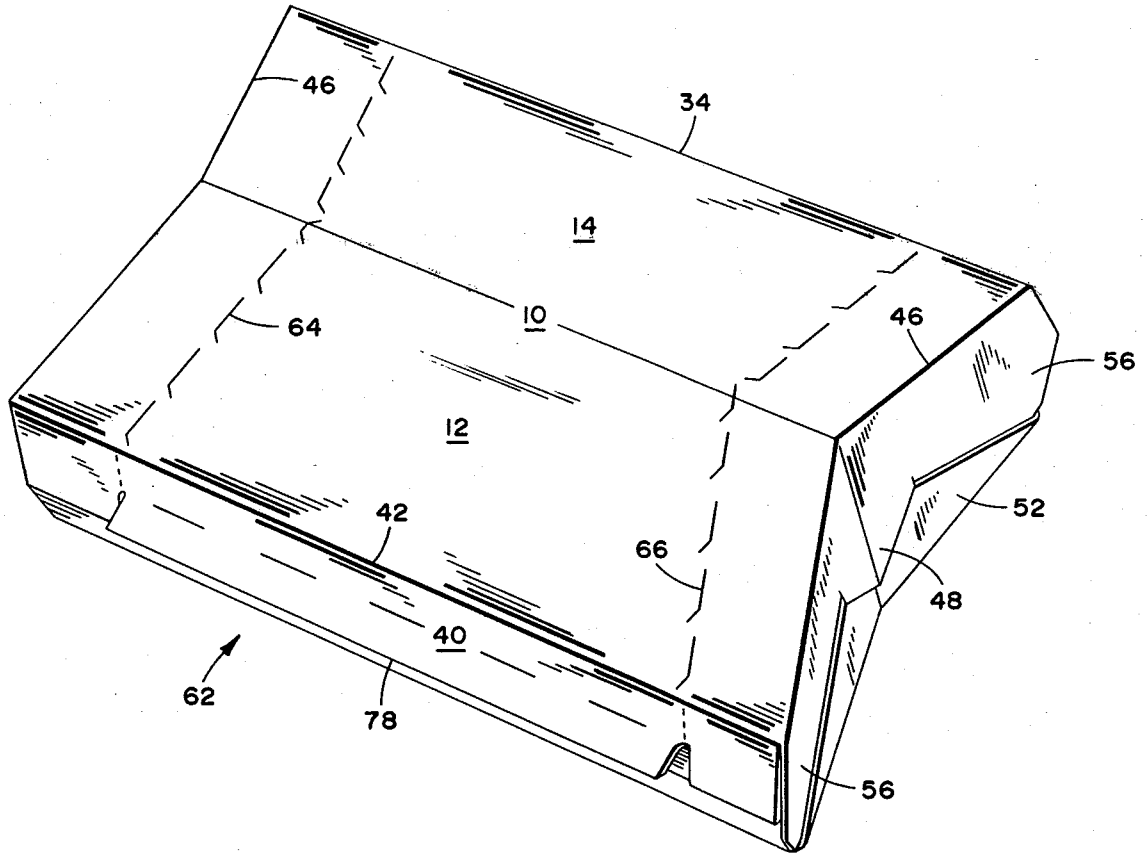
FIG. 4 is an isometric view of the carton which is constructed by folding and tubing the blank illustrated in FIG. 1 and which illustrates the tear strip across the top thereof which can be utilized to expose the contents of the carton.

When the carton is received by the user thereof, it is quickly restored to the shape shown in FIG. 2 by again pivoting top wall 10 with respect to bottom wall 16 about score lines 34, 36, 38, and 42. To close one end of the carton, generally U-shaped major end panel 44 is pivoted downwardly about tear line 46 and minor end flap 52 is pivoted upwardly about tear line 54. Minor end flap 52 then overlaps major end panel 44. By continuing to press down on minor end panel 52, the triangular projection 68 slips under triangular shaped locking tab 48 of major end panel 44, thus partially overlapping arms 56 as shown in FIG. 4 to close the end of the carton.

Figure 3:
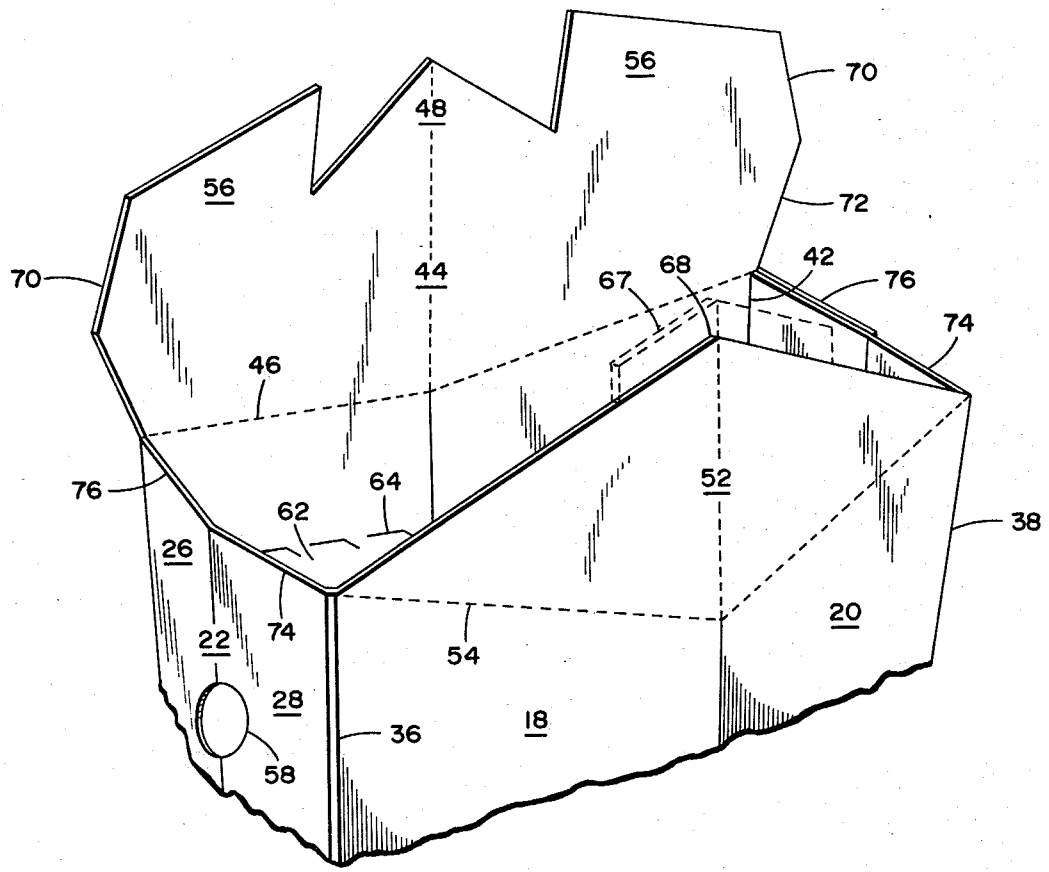
FIG. 3 is a partial view of the novel carton showing one end thereof in its opened condition and illustrating the details of the major and minor panels forming the end closure.

FIG. 3 is a partial isometric view of one end of a carton that has been folded and tubed. The general U-shape form of major end panel 44 can be seen with locking tab 48, which is triangular shaped, located at the bottom of the U and being integrally formed therewith. A part of tear line 64 which forms an edge of tear strip 62 can be seen. To close the end of the carton shown in FIG. 3, the major end panel 44 is folded out of the plane of the paper about tear line 46. It will be noted that the outer edges 70 and 72 of arms 56 of major end panel 44 are shaped to conform to the top edges 74 and 76, respectively, of first and second panels 26 and 28 which form side wall 22.

As shown in dashed lines in FIG. 3, if greater structural stability is desired, an extension 67 may be formed outwardly from triangular projection 68 to create shoulders which positively lock under locking tab 48.

When minor end panel 52 is folded inwardly about tear line 54, it overlaps a part of the arms 56 of U-shaped major end panel 44. Continued inward movement of minor end panel 52 causes triangular shaped projection 68 to extend under triangular shaped locking tab 48 and lock the two end panels 44 and 52 together in a detachable manner.

FIG. 4 is an isometric view of a carton that has been folded and tubed with both ends thereof closed. In FIG. 4, minor end panel 52 has been inserted under locking tab 48 of major end panel 44 and partially covers arms 56 thereof in nonadhesive and mechanically interlocking fashion. When the carton has been filled with product such as french fries while in the configuration shown in FIG. 3, it can then be closed on the one open end as shown in FIG. 4. The filled carton, as shown in FIG. 4, can be stacked in the position shown or turned over 180° or turned 90° in either direction and stacked on its side or can be tipped up and stacked on either end. Thus, the carton is easy to handle and convenient to temporarily store food products while awaiting purchase by the customer. In any position that it is placed, the contents will not fall out. After the carton has been purchased by the customer and it is desired to retrieve the contents, the customer may open either end of the carton simply by inserting a sharp object such as the fingernail under the locking tab 48 of major end panel 44 and lifting up. The carton can be opened, the contents totally or partially removed and the end closed again in the manner described previously.

If desired, the carton may be opened by removing tear strip 62 simply grasping edge 78 of glue panel 40 and lifting upwardly. The tear strip 62 separates along tear lines 64 and 66 which extend across both panels 12 and 14 which form top wall 10. Thus, the entire tear strip 62 may be removed back to edge 34 thereby exposing the contents of the carton which may be removed. Tear strip 62 may be as wide as necessary to enable the product to be removed from the carton conveniently.

Thus, there has been disclosed a novel carton for the fast food industry which can be transported in its flat condition, quickly set up and filled with product and both ends closed in order to prevent the product from escaping. While in the position of having both ends closed, it can be stacked on either of the top or bottom walls, either of the side walls or either of the ends until the customer purchases it. In addition, the customer may remove the contents simply by opening either end of the carton and reclosing it if desired or by removing the tear strip which extends across the top panel of the carton thus enabling the contents to be removed easily. Further, while the food product to be used in said carton has been generally referred to herein as "french fries", it is to be understood that other foods such as onion rings, candies, desserts, and the like, as well as other products, may also be inserted in said carton.

It is understood that suitable modifications may be made in the carton as described and disclosed provided that such modifications come within the spirit and scope of the appended claims.

What is claimed is:

1. A multiple access carton comprising:
   a. top, bottom and side wall members hingedly connected by fold lines to form a carton body,
   b. major and minor panels on each end of said carton for nonadhesively and mechanically detachably interlocking with each other to form an end closure,
   c. said panels including:
      i. a generally U-shaped major end panel attached to each end of said carton body and having a locking tab integrally formed therewith, said locking tab being located at the bottom of and extending toward the open end of said U, and ii. a projection forming said minor end panel and hingedly attached to each end of said carton body opposite the major end panel at that end for at least partially overlapping the arms of said U and extending at least partially under said locking tab for interlocking said major and minor end panels thereby forming said end closures, and d. a tear strip formed in and extending across said top wall and of sufficient width whereby the contents of said carton may be conveniently retrieved through either of said non-adhesively and mechanically detachably interlocked end closures or through said top wall when said tear strip is removed.

2. A carton as in claim 1 wherein both said locking tab and said interlocking projection are triangularly shaped.

3. A carton as in claim 2 further including at least one orifice in said side panels for venting heat when said carton contents are hot.

4. A multiple access carton comprising:

a. front and back walls each being integrally formed of first and second panels of equal size, b. first and second side walls, each being integrally formed of third and fourth panels of equal size but of smaller widths than said first and second panels, said first and second side walls being integrally formed with and hingedly attached to said front and back walls to form an octagonal shaped carton body, c. a major panel integrally formed with, removably attached to and extending from each end of said front wall, d. a minor panel integrally formed with, removably attached to and extending from each end of said back wall for nonadhesively and mechanically detachably interlocking with a corresponding one of said major panels to form an end closure which can be opened and reclosed as necessary to remove or retain the carton contents, e. a glue flap hingedly attached to and integrally formed with one side edge of said top wall and overlapping one of said side wall panels for glue attachment thereto, and f. a tear strip formed in said glue flap and extending across both panels of said top wall and being of sufficient width to allow the contents of said carton to be easily removed when said tear strip is removed.

5. A carton as in claim 4 wherein said major and minor interlocking end panels comprise:

a. a generally U-shaped major end panel having the arms thereof shaped to conform to the end edges of said third and fourth panels forming said side walls and including a triangular shaped locking tab integrally formed therewith, said locking tab located at the bottom of and extending toward the open end of said U, and b. a triangular shaped minor end panel for overlapping the arms of said U-shaped major end panel and extending under said triangular shaped locking tab for detachably interlocking with said major end panel to form an end closure.

6. A carton blank comprising:

a. a top and bottom wall each formed of equal size first and second panels, b. first and second side walls each formed of equal size third and fourth panels of smaller width than said first and second panels, sid first side wall integrally formed with and hingedly connecting said top and bottom walls, said second side wall integrally formed with and hingedly attached to the remaining side edge of said bottom wall whereby an octagonal carton is formed when said blank is tubed and folded, c. a flue flap integrally formed with and hingedly attached to the remaining side edge of said top wall for overlapping the adjacent side wall when said carton blank is folded and tubed, d. a generally U-shaped major end panel integrally formed with and hingedly extending from each end of said front wall, e. a triangular shaped locking tab located at the bottom of, integrally formed with and extending toward the open end of said U, f. a triangular shaped projection integrally formed with and detachably connected to each end of said bottom wall and forming a minor end panel for overlapping the arms of said U-shaped major end panel and extending under said triangular shaped locking tab when said carton is folded and tubed to detachably interlock said major and minor end panels thereby forming end closures, and g. a tear strip formed in said glue flap and extending across both first and second panels of said top wall and being of sufficient width to allow the contents to be easily removed from the carton when said blank is folded and tubed.

7. The carton blank of claim 6 further including at least one orifice in one of said side walls for venting any heat generated by the contents of the carton formed when said blank is folded and tubed.

* * * * *